US005333123A

United States Patent [19]

Plancon et al.

[11] Patent Number: 5,333,123

[45] Date of Patent: Jul. 26, 1994

[54] CONTINUOUS WATERPROOF TIMEPIECE CASE WITH INTEGRAL CASE BACK BLANK

[75] Inventors: Michel Plancon, Watertown, Conn.; Jean L. Cuinèt, L'Osnom, France

[73] Assignee: Timex Corporation, Middlebury, Conn.

[21] Appl. No.: 96,355

[22] Filed: Jul. 23, 1993

[51] Int. Cl.[5] ..... G04B 37/00

[52] U.S. Cl. ..... 368/276; 368/294; 368/309

[58] Field of Search ..... 368/276, 287, 294–296, 368/309

[56] References Cited

U.S. PATENT DOCUMENTS

| | | | |
|---|---|---|---|
| 3,789,605 | 2/1984 | Kisaida | 368/276 |
| 4,136,515 | 1/1979 | Thompson et al. | 58/90 |
| 4,188,778 | 2/1980 | Wuthrich | 58/88 |
| 4,291,402 | 9/1981 | Nakajima et al. | 368/276 |
| 4,397,567 | 8/1983 | Carl | 368/309 |
| 4,403,870 | 9/1983 | Thompson et al. | 368/294 |
| 4,421,423 | 12/1983 | Lederrey | 368/291 |
| 4,511,260 | 7/1985 | Pasquier | 368/69 |
| 4,561,783 | 12/1985 | Lederrey | 368/309 |
| 4,648,722 | 3/1987 | Mock et al. | 368/294 |
| 4,668,101 | 3/1987 | Wuthrich | 368/296 |
| 5,244,134 | 9/1993 | Riley | 224/164 |

*Primary Examiner*—Vit W. Miska

*Attorney, Agent, or Firm*—William C. Crutcher; Lise A. Rode

[57] ABSTRACT

A water-resistant timepiece of the type including a crystal, a timepiece dial and movement assembly, and a long-life energy cell, which comprises a continuous case of plastic having: a first outer peripheral member adapted to receive said dial and movement assembly and the long-life energy cell, and further adapted to receive the crystal to form a water-resistant seal therewith; a thin substantially flat case back wall integral with the peripheral member to form an annular edge; and a peripheral groove located in the bottom of the peripheral member. A case back blank of substantially uniform thickness, having a substantially flat central portion and an integral peripheral side wall, and preferably made of stainless steel, cooperates with the peripheral groove of the case to integrally attach the case back blank to the case to complete a thin timepiece having improved water resistance, high mechanical and structural integrity, and an aesthetic appearance.

17 Claims, 2 Drawing Sheets

CONTINUOUS WATERPROOF TIMEPIECE CASE WITH INTEGRAL CASE BACK BLANK

This invention relates to an improved case for timepieces having long-life energy cells. More specifically, this invention relates to a timepiece case of minimum thickness which is composed of plastic and a high strength material such as stainless steel, and which has a high reliability of mechanical/structural and water resistant integrity.

Timepieces are well known in the art which are relatively impervious to water up to varying atmospheric pressure levels. Various inventions have been suggested to improve water resistance, many of which are directed towards improvements in the watch crown area and in the area where the timepiece crystal is attached to the timepiece bezel. Although inventions have been suggested to prevent water leakage through the case back area of a timepiece, the very nature of prior timepieces (i.e., separate bezel and case back members) dictates that the timepiece is still vulnerable to water leakage.

Thus, it will be understood that water leakage through the back of the timepiece could be completely eliminated if instead of comprising a separate bezel and case back member, the timepiece case comprised one continuous member, wherein the timepiece movement and other elements of the timepiece were placed into the timepiece through a front opening in the continuous case into which the crystal is later disposed to form a tight seal (generally via snap fit arrangement or ultrasonic welding).

Until recently, such a design was not needed because of the timepiece operator's aforementioned necessity to have access to the timepiece cavity to replace the energy cell after it had discharged. However, it has recently been suggested to power timepieces with thin, coin-shaped lithium energy cells; see, e.g., U.S. Pat. Nos. 4,453,833 and Ser. No. 07/876,318, the latter of which has been assigned to the assignee of the instant application. Lithium cells are desirable for timepiece use since the lower rate of self-discharge and larger energy capacity per unit volume for the lithium energy cells allow cell lives as great as ten years, thereby reducing the need for energy cell replacement over the life of the timepiece. As a result the timepiece user does not require access to the energy cell cavity at any time for the approximate ten year life period of the lithium cell. Therefore it has now become economically feasible to provide the timepiece with a single continuous case, instead of separate and removable bezel and case back members. Further, as it is known to ultrasonically weld the timepiece crystal to a bezel portion of the timepiece, the only potential remaining entry point would be the crown area (which would be protected by gaskets or other water resistance devices as for example was shown above).

A continuous case is disclosed in U.S. Ser. No. 07/860,932—Riley, which is assigned to the assignee of the present invention. Riley shows a sealed continuous case which includes peripheral side walls containing the timepiece movement and integral case back wall. The case is molded of rigid plastic material which is then overmolded with soft flexible plastic material for the timepiece strap. This sealed case construction provides for improved water resistance, but at the expense of an increase in overall timepiece thickness and cost as a result of the overmolding process. As timepiece cost and aesthetics, including overall thinness, are important to the operator, this construction has some drawbacks.

In addition to water resistance and aesthetics, structural integrity is also important to the operator. For those aforementioned timepieces which have a separate plastic bezel and a stainless steel case back (as is known in the art), breakage of the plastic portion has often been encountered as a result of the stress necessary to provide a tight water-resistance seal between the case back and bezel. As seen in Riley above, a continuous case construction of plastic alone would require increased thickness in order to preserve the structural integrity of the case back portion and timepiece overall, and in light of certain health and safety regulations, would only be usable where the timepiece casing is neither painted nor plated. As thinner timepieces which may be painted or plated are considered more attractive and desirable, this alternative is generally not a viable one. Alternatively, a continuous case made entirely of stainless steel is pleasing in appearance and able to withstand higher stress; for most purposes, however, such a construction is unjustifiably expensive, and therefore also nonviable.

It would therefore be desirable to provide a thinner, inexpensive timepiece with a single continuous case to improve water resistance, while maintaining the highest possible structural stability and aesthetic appearance.

Therefore one object of the present invention is to provide a timepiece with improved water resistance.

Another object of the present invention is to provide improved water resistance for a thin timepiece.

A further object of the present invention is to provide improved water resistance for a thin timepiece which is powered by a long-life energy cell.

An additional object of the present invention is to provide a high quality, thin timepiece having a stainless steel case back, which has improved water resistance reliability, a high overall structural integrity and aesthetic appearance.

DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

SUMMARY OF THE INVENTION

Briefly stated, the invention comprises an improvement in a water-resistant timepiece of the type including a crystal, a timepiece dial and movement assembly, and a long-life energy cell, the improvement comprising a continuous case of plastic having: a first outer peripheral member adapted to receive said dial and movement assembly and the long-life energy cell, and further adapted to receive the crystal to form a water-resistant seal therewith; a thin substantially flat case back wall integral with the peripheral member to form an annular edge; and a peripheral groove located in the bottom of the peripheral member. A case back blank of substantially uniform thickness, having a substantially flat central portion and an integral peripheral side wall, and preferably made of stainless steel, cooperates with the peripheral groove of the case to integrally attach the case back blank to the case.

DESCRIPTION OF THE PREFERRED EMBODIMENT

It is generally known in the art to construct a timepiece with separate and distinct bezel and case back members, which may be affixed to each other by screws, or like means which allow for subsequent detachment of said members from one another. Such construction is generally necessary during assembly of the timepiece in order to allow placement of the timepiece movement, or portions thereof, into the timepiece through the timepiece back side. Such construction is also generally necessary to allow the timepiece operator access to the energy cell cavity in order replace the cell when it has expired.

However, as stated previously, it has recently been suggested to power a timepiece with a thin, coin-shaped, lithium energy cell. As such cells have lives lasting up to at least ten years (as opposed to the standard two to three year life of a silicon oxide energy cell), the timepiece operator does not need ready access to the energy cell cavity. It is further known to assemble a timepiece movement through a front loading process, wherein the timepiece movement is inserted into the timepiece cavity through the front opening in the bezel into which the crystal is later disposed to form a tight seal (generally via ultrasonic welding). As a result, it is no longer necessary to have ready access to the timepiece inner cavity through a separate case back member either during assembly or subsequent thereto, and therefore it is economically feasible to provide a timepiece case which comprises a single continuous case, instead of separate bezel and case back members.

Figure 1:
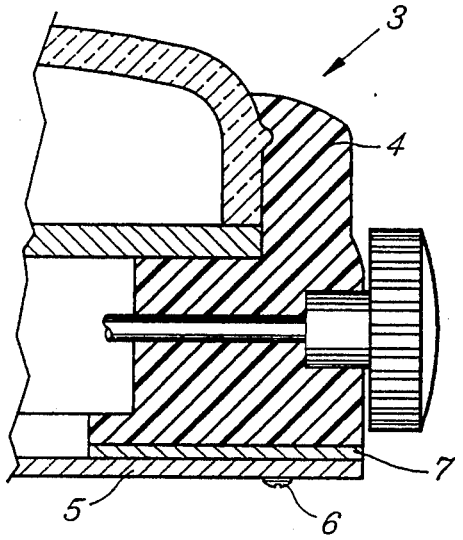
FIG. 1 is an enlarged elevation cross-sectional drawing of a prior watch case construction, wherein a thin case back blank is affixed to a separate bezel member.

A prior construction for a timepiece having separate bezel member and stainless steel case back is shown in FIG. 1. Watch case 3 comprises separate bezel member 4 and a thin case back blank 5 affixed thereto by any of the various means known in the art (screw 6 as shown in FIG. 1). Because of the separate nature of the bezel member 4 and case back blank 5, gasket 7 is disposed therebetween, and in the construction of FIG. 1 is clamped via the screw 6 in order to prevent water entry. While such construction is generally effective in preventing water entry, the very nature of the two-piece case dictates that the timepiece is still vulnerable to water leakage. Furthermore, breakage of the case is often encountered during attachment of the case back blank 5 to the case 3, due to the substantial pressure necessary to provide the timepiece with a tight seal at the case back area.

Figure 2:
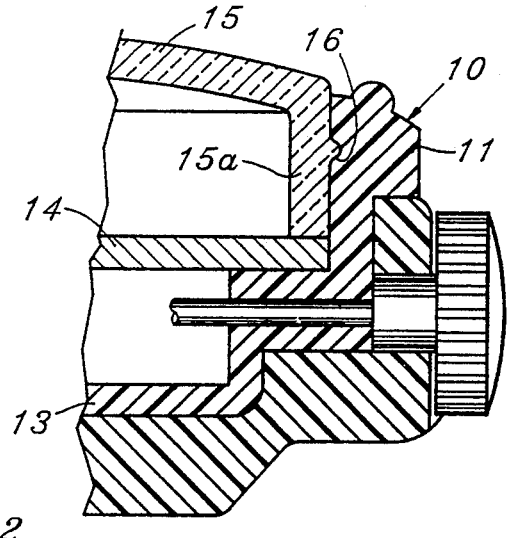
FIG. 2 is an enlarged elevation cross-sectional drawing of another prior watch case construction wherein the case comprises a single continuous piece.

FIG. 2 shows another prior construction for a sealed case. Watch case 10 is molded of rigid plastic material and includes peripheral side walls 11 containing the movement (not shown) and an integral case back wall 13. Watch dial 14 rests on a ledge in side walls 11 and is held in place by a peripheral flange 15*a* on watch lens 15, the latter being held with a snap connection 16 in case 10, although ultrasonic welding may also be used. The periphery and case back of the case 10 are enveloped and overmolded by a soft flexible material such as polyvinyl chloride or polyurethane. As shown in FIG. 2, although there is provided a sealed case back portion of the timepiece, thus necessarily improving the imperviousness of the timepiece to water, such waterproofing is accomplished only through the sacrificing of desired thinness of the timepiece and expense due to the costly overmolding process.

Figure 3:
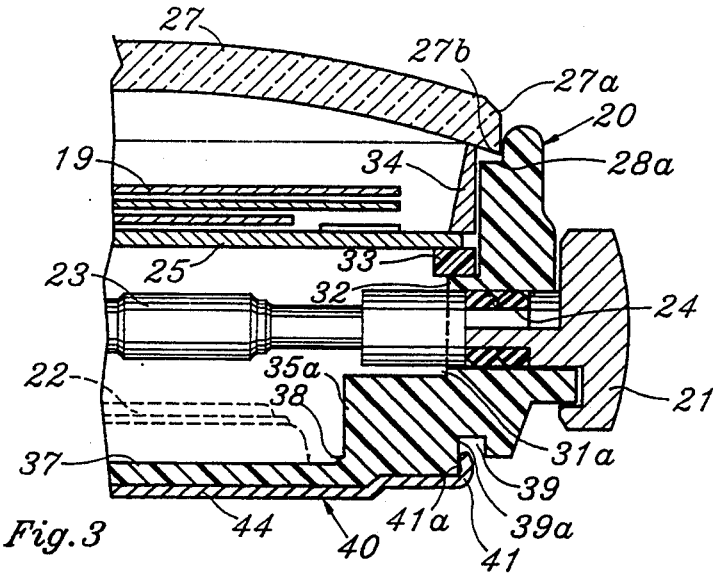
FIG. 3 is an enlarged elevation cross-sectional drawing of the watch case assembly of the preferred embodiment of the present invention, taken along lines through the pendant and crown sections.

Referring to the present invention as shown in FIG. 3, the assembly of elements shown in the figure comprise a crystal 27 of the type having a uniform thickness and bevelled outer peripheral edge 27*a*, a continuous case 20, a case back blank 40, a long-life energy cell 22, watch crown 21, winding and setting stem 23, gaskets 24, and a portion of the watch movement 19 including dial 25. Although an analog movement is shown in FIG. 3, it will be appreciated that an analog movement is not material to the subject invention, and that solid-state digital timekeeping means of a type well known in the art may be substituted.

Figure 6:
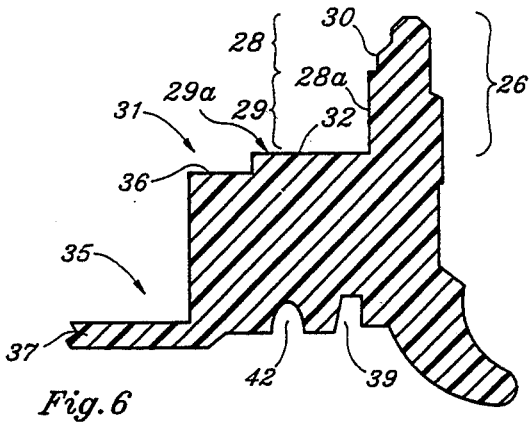
FIG. 6 is an enlarged elevation cross-sectional drawing of the watch case of the preferred embodiment of the present invention, taken along the lines 6—6 as shown in FIG. 5.

The single piece continuous timepiece case 20, is preferably made of a hard plastic material such as ABS plastic, and may be plain, painted or plated. Referring to FIGS. 3 and 6, the case 20 comprises a first outer peripheral member 26 which generally circumferentially encircles the crystal 27 and generally comprises a first and second section 28, 29. Specifically, the first section 28 of the first outer peripheral member 26 has an interior wall 28*a*, which has a plurality of bevelled edges 30 thereon and which generally conforms to a portion of the bevelled outer peripheral edge 27*a* of the crystal 27 (FIG. 3). Preferably, the crystal 27 is ultrasonically welded to the case 20 to form a tight water-resistant seal therewith. In the preferred embodiment of FIG. 3, an interior corner 27*b* of the crystal 27 extends into the interior case wall 28*a* to guide the placement of the crystal 27 into the timepiece case during assembly and to further support the crystal's attachment to the case 20.

The first outer peripheral member 26 further comprises a second section 29 which is integral with the said first section 28 and comprises a first cylindrical bore 29*a* which is defined by the case 20 and extends in an axial direction therein (FIGS. 3 and 6). As seen in FIG. 3, the timepiece movement and dial assembly 19 is generally disposed in the space comprising the first cylindrical bore 29*a*.

A second generally cylindrical bore 31 defined by the case 20 and extending in an axial direction therein, has a diameter which is less than that of the first generally cylindrical bore 29*a* and is integral therewith to form a first annular shoulder 32. In the preferred embodiment of FIG. 3, a spacer element 33, is supported by the first annular shoulder 32, the dial 25 of the dial and movement assembly 19 resting thereon. The spacer element 33 is used to enable the assembly into the timepiece of different movements having different thicknesses, thus allowing the case to be universally available for various and different timepiece constructions. During assembly of the timepiece, the dial and movement assembly 19 are placed through the top (open) end of the timepiece and press-fit between the spacer element 33, and the ring reflector element 34 (described below). The spacer element 33, which is preferably made of molded plastic, is optional and not material to the subject invention.

Figure 7:
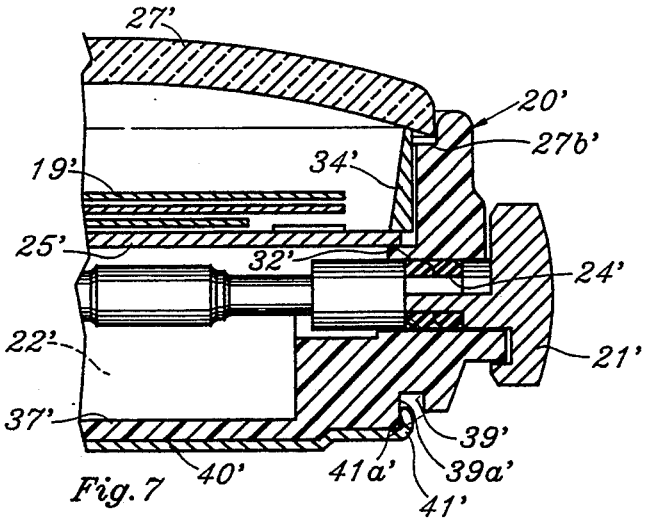
FIG. 7 is an enlarged elevation cross-sectional drawing of the watch case assembly of an alternate embodiment of the present invention, taken along lines through the pendant and crown sections.

In the preferred embodiment (FIG. 3), a ring-reflector element 34 is disposed between the inner surface of the crystal 27 and the timepiece dial 25, and is preferably made of turned brass or plated molded plastic. The ring-reflector element 34 serves a dual function. First, it provides a press-fit means for fixation of the movement and dial assembly 19 between itself and either the first annular shoulder 32, or, in the preferred embodiment, the spacer element 33 (FIGS. 3 and 7). Second, the ring reflector 34, serves to enhance the aesthetic appearance of the watch to the timepiece operator.

The continuous case 20 further defines a third generally cylindrical bore 35 which extends axially into the timepiece. The third generally cylindrical bore 35 has a diameter which is less than that of the second generally cylindrical bore 31 and is integral therewith to form a second annular shoulder 36. The third generally cylindrical bore 35 circumferentially surrounds the long-life energy cell 22 which rests upon a thin substantially flat central portion, or case back wall 37 of the case 20. The case back wall 37 is integral with said third generally cylindrical bore 35 at one end opposite said second annular shoulder 36 and preferably forms a bevelled edge 38 therewith. In the preferred embodiment, the third generally cylindrical bore 35 has a depth which is at least as great as the thickness of the long-life energy cell 22.

Figure 4:
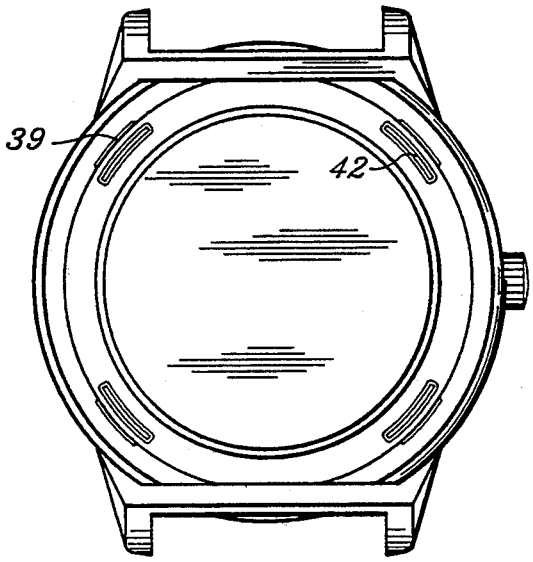
FIG. 4 is a bottom plan view of the continuous case of the instant invention.

As shown in FIGS. 4 and 6, a peripherally circumferential groove 39 is disposed in the case 20 and serves as means for attaching a thin case back blank 40 of uniform thickness and high strength material, such as stainless steel or titanium. The case back blank 40 has a substantially flat central portion 44, and flanged edges 41, the interior wall **41*a* of which generally conforms to an interior wall 39*a* of the groove 39 in order to attach case back blank 40 to the case 20. Attachment of the case back blank 40** may be accomplished via a snap-fit arrangement or via epoxy fixation.

A plurality of grooves 42 (four as shown in FIG. 4) which are generally oblong in shape, are peripherally-spaced on the case back wall 37 adjacent in a radially inward direction to the groove 39 and serve to provide a connection area for electroplating. Furthermore, in those timepieces for which the case back blank 40 is snap-fitted onto the case 20, said grooves 42 further function to allow some flexibility during assembly to avoid breakage of same during the assembly process.

Referring to FIGS. 3 and 6, it will be appreciated why the second and third bores are herein deemed "generally" cylindrical. In a timepiece having an analog movement (as herein shown), at that point in the case 20 where the winding and setting stem 23 is located, a small arcuate portion of the bore wall **31*a* of the second generally cylindrical bore 31 has a greater axial dimension then elsewhere in the second bore 31. In addition, the first annular shoulder 32 is narrower at this point then elsewhere on the shoulder. Similarly, a small arcuate portion of the bore wall 35*a* of the third cylindrical bore 35 has a smaller axial dimension then elsewhere in the third bore, while the second annular shoulder 36 is wider at this point in the case 20. Thus the case is thus radially thinner at this point than anywhere else in this otherwise uniformly-dimensioned case. It will be appreciated that were the case 20 to have the same radial dimension at this point as elsewhere along the case, it would have to very finely and precisely machined to accommodate the various radial dimensions and fragility of the winding and setting stem 23, and to allow for sufficient clearance so that the winding and setting stem 23 could be properly rotated during such watch functions as timesetting. As shown in FIG. 3, in the instant invention, the case 20 only partially encases winding and setting stem 23** which makes assembly of same into the case easier and more inexpensive. It will be further appreciated, however, that this construction does not compromise the mechanical or structural integrity of the instant invention.

Figure 5:
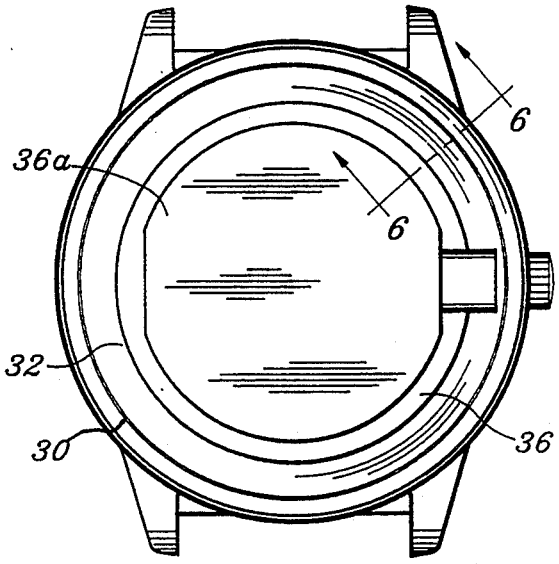
FIG. 5 is a top plan view of the continuous case.

FIGS. 4 and 5 respectively show a bottom and top plan view of the case of the present invention. As seen in FIG. 5, the second annular shoulder 36 forms an opening **36*a*** which is generally elliptical in shape in the preferred embodiment of the instant invention.

FIG. 7 shows an alternate embodiment of the present invention, wherein the dial and movement assembly 26' are directly supported by the second annular shoulder 36', the absence of the spacer element 33' further serving to decrease the thickness of the timepiece.

It will now be readily apparent from the foregoing description that timepiece water resistance will be markedly improved, for the single piece case 20 of the present invention allows for no water leakage through that portion of the case generally identified as the case back portion. And as the timepiece crystal is ultrasonically welded to the timepiece case (under a process which is generally known in the art), which prevents water leakage through the crystal area of the timepiece, the only available point for water entry will be the crown area which is well protected by two gaskets 24.

Furthermore, this improved water resistance is obtained with minimum thickness penalty and maximum mechanical/structural integrity. The plastic/stainless steel construction of the case 20 of the invention provides full water resistance as well as mechanical/structural integrity under 30 to 50 meters of water pressure with a minimal case back section (case back wall plus case back blank) thickness on the order of 0.8 mm. As seen in the prior art of Riley (FIG. 1), in order to ensure the same water and mechanical/structural resistance in an equivalent plastic integrated case back having separate bezel and case back members, a case back member of 1.5 mm would be required. Further, such case back would only be capable of use in timepieces having plain plastic cases (as plated or painted cases cannot be in direct contact with the timepiece wearer's skin). Additionally, as gaskets between the case back and bezel members are no longer required under the present invention, the stress which is ordinarily applied on the bezel through the gasket in order to ensure watertight seal is eliminated, thereby creating a solid and stress-free bezel having higher mechanical and structural integrity.

It therefore will be appreciated that the aforementioned construction allows for a thin timepiece having improved water resistance while still maintaining a high mechanical and structural integrity and an aesthetic appearance.

While there has been described what is considered to be the preferred embodiment of the invention, other modifications will occur to those skilled in the art, and it is desired to secure in the appended claims all such modifications as fall within the true spirit and scope of the invention.

What is claimed is:

1. Improvement in a water-resistant timepiece of the type including a crystal, a timepiece dial and movement assembly, and a long-life energy cell, which comprises:

a continuous case of plastic having:

(a) a first outer peripheral member adapted to receive said dial and movement assembly and said long-life energy cell, and further adapted to receive said crystal to form a water-resistant seal therewith;

(b) a thin substantially flat case back wall integral with said peripheral member to form an annular edge;

(c) a first peripheral groove located in the bottom of said peripheral member; and, a case back blank composed of high strength material of substantially uniform thickness and having a substantially flat central portion and an integral peripheral side wall and cooperating with said peripheral groove of said case to integrally attach said case back blank to said case.

2. The improvement of claim 1, wherein:

said crystal has a bevelled outer peripheral edge;

said first outer peripheral member further comprises a first section including an interior wall having a plurality of bevelled edges which surrounds and generally conforms to a portion of said bevelled outer peripheral edge of said crystal, and a second section integral with said first section and comprising a first cylindrical bore defined by said continuous case and extending therein;

said first outer peripheral member further defines a second generally cylindrical bore extending into said case and having a diameter less than that of said first cylindrical bore and being integral therewith to form a first annular shoulder; and, said first outer peripheral member further defines a third generally cylindrical bore extending into said case and having a diameter less than that of said second generally cylindrical bore and being integral therewith to form a second annular shoulder.

3. The improvement of claim 2, wherein the crystal is attached to the interior wall of said first case section via ultrasonic welding to form a watertight seal, the crystal having an interior corner which extends into the interior surface of said interior case wall to guide said crystal into said case during assembly and to further support the attachment of the crystal to the case side wall.

4. The improvement of claim 2, wherein said dial of said dial and movement assembly is partially supported by said first annular shoulder, and further comprising spacer means disposed between said dial and movement assembly and said first annular shoulder of said first cylindrical bore to enable the assembly of different-sized watch timepiece movements into said timepiece.

5. The improvement of claim 2, further comprising a ring reflector element which is disposed between the interior surface of said crystal and said dial of said watch dial and movement assembly, to enable a press-fit fixation of said dial and movement assembly into the timepiece.

6. The improvement of claim 2, wherein said first peripheral groove circumferentially surrounds a portion of said third cylindrical bore, and further comprising a plurality of grooves circumferentially spaced on the periphery of said case adjacent in a radially inward direction to said first groove, said plurality of grooves providing some flexibility during attachment of said case back blank to said case to avoid breakage of the case during the assembly process.

7. The improvement of claim 2, further comprising:

a winding and setting stem extending radially though said continuous case;

wherein a section of said continuous case surrounding said winding and setting stem further defines an arcuate portion of said second generally cylindrical bore to have an axial dimension greater than said first axial dimension and an arcuate portion of said third cylindrical bore to have an axial dimension less than that of said second axial dimension; and, wherein said first annular shoulder has a radial dimension smaller than said first radial dimension and said second annular shoulder has a radial dimension larger than said second radial dimension in said section.

8. The improvement of claim 2, wherein said second annular shoulder is generally elliptical in shape.

9. The continuous case of claim 1, wherein said annular edge is bevelled.

10. The continuous case of claim 2, wherein the thickness of said large diameter energy cell is no greater than the depth of said third cylindrical bore.

11. The continuous case of claim 1, wherein said case back wall of said case is thinner than said central portion of said case back blank.

12. The continuous case of claim 1, wherein the total thickness of said case back wall of said case and said central portion of said case back blank is on the order of 0.8 millimeters.

13. The continuous case of claim 12, wherein the thickness of said case back wall of said case is on the order of 0.5 millimeters.

14. The continuous case of claim 12, wherein the thickness of said central portion of said case back blank is on the order of 0.3 millimeters.

15. The continuous case of claim 1, wherein the case back blank is attached to the case via snap-fit means or epoxy glue.

16. The continuous case of claim 1, wherein the case back blank is composed of stainless steel.

17. The continuous case of claim 1, wherein the timepiece is water resistant up to 50 meters pounds per square inch.

* * * * *